US009502203B1

(12) United States Patent
Borchard

(10) Patent No.: US 9,502,203 B1
(45) Date of Patent: Nov. 22, 2016

(54) ELECTRON BEAM GUN WITH KINEMATIC COUPLING FOR HIGH POWER RF VACUUM DEVICES

(71) Applicant: Dymenso LLC, San Francisco, CA (US)

(72) Inventor: Philipp Borchard, San Francisco, CA (US)

(73) Assignee: Dymenso LLC, San Francisco, CA (US)

( * ) Notice: Subject to any disclaimer, the term of this patent is extended or adjusted under 35 U.S.C. 154(b) by 0 days.

(21) Appl. No.: 14/977,110

(22) Filed: Dec. 21, 2015

(51) Int. Cl.

| | |
|---|---|
| ***H01J 23/06*** | (2006.01) |
| ***H01J 29/04*** | (2006.01) |
| ***H01J 29/48*** | (2006.01) |
| ***H01J 29/58*** | (2006.01) |

(52) U.S. Cl.
CPC ..... *H01J 23/06* (2013.01); *H01J 29/04* (2013.01); *H01J 29/485* (2013.01); *H01J 29/58* (2013.01); *H01J 2223/06* (2013.01); *H01J 2223/08* (2013.01); *H01J 2229/481* (2013.01); *H01J 2229/4831* (2013.01)

(58) Field of Classification Search
CPC ..... H01J 23/06; H01J 29/04; H01J 29/485; H01J 29/58; H01J 37/06; H01J 37/065; H01J 3/00; H01J 3/02
See application file for complete search history.

(56) References Cited

U.S. PATENT DOCUMENTS

| | | | | |
|---|---|---|---|---|
| 4,607,187 | A | 8/1986 | Villanyi | |
| 5,416,381 | A | 5/1995 | Scarpetti, Jr. | |
| 5,608,773 | A * | 3/1997 | Korenaga | G03F 7/707 378/208 |
| 6,193,430 | B1 | 2/2001 | Culpepper | |
| 6,746,172 | B2 | 6/2004 | Culpepper | |
| 2003/0053048 | A1 * | 3/2003 | Bennett | G01J 3/02 356/301 |
| 2003/0086748 | A1 | 5/2003 | Culpepper | |
| 2003/0098424 | A1 * | 5/2003 | Shamoun | B82Y 10/00 250/492.1 |
| 2009/0231594 | A1 * | 9/2009 | Harris | B82Y 10/00 356/500 |
| 2010/0046712 | A1 * | 2/2010 | Behling | A61B 6/032 378/124 |
| 2015/0268446 | A1 * | 9/2015 | Chen | G02B 9/62 348/148 |

* cited by examiner

*Primary Examiner* — Anne Hines
(74) *Attorney, Agent, or Firm* — Lumen Patent Firm

(57) ABSTRACT

An electron beam gun for a high power RF vacuum device has components joined by a fixed kinematic coupling to provide both precise alignment and high voltage electrical insulation of the components. The kinematic coupling has high strength ceramic elements directly bonded to one or more non-ductile rigid metal components using a high temperature active metal brazing alloy. The ceramic elements have a convex surface that mates with concave grooves in another one of the components. The kinematic coupling, for example, may join a cathode assembly and/or a beam shaping focus electrode to a gun stem, which is preferably composed of ceramic. The electron beam gun may be part of a high power RF vacuum device such as, for example, a gyrotron, klystron, or magnetron.

20 Claims, 6 Drawing Sheets

Fig. 1A
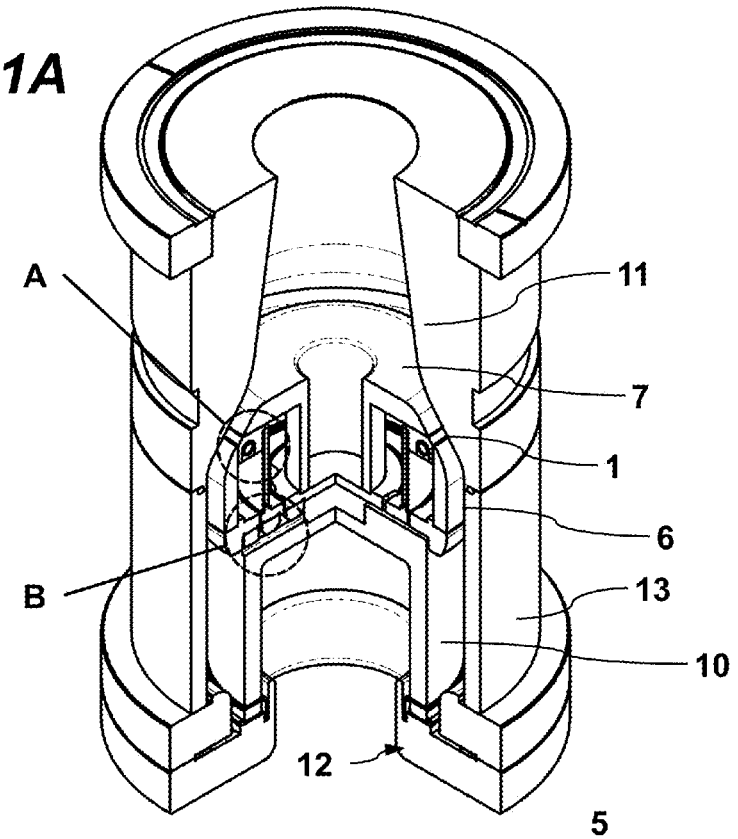
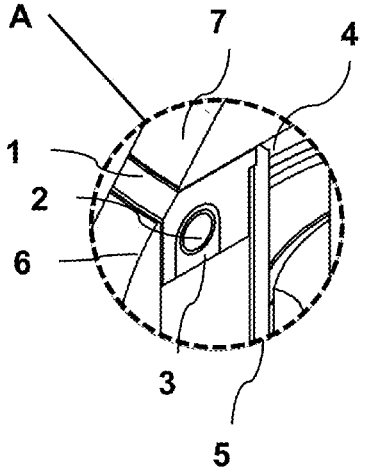
Fig. 1C
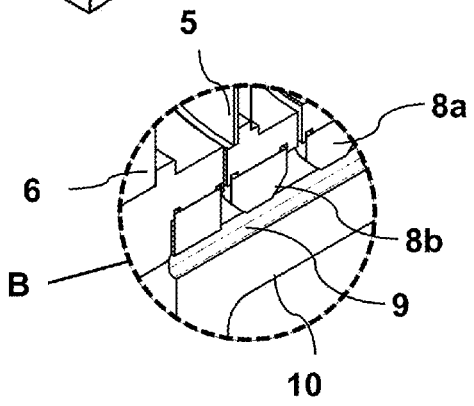
Fig. 1B

ELECTRON BEAM GUN WITH KINEMATIC COUPLING FOR HIGH POWER RF VACUUM DEVICES

STATEMENT OF GOVERNMENT SPONSORED SUPPORT

This invention was made with Government support under Contract No. DE-SC0009599 awarded by the Department of Energy. The Government has certain rights in the invention.

FIELD OF THE INVENTION

The present invention relates to high power RF vacuum devices. More specifically, it relates to high power electron beam guns designed for alignment with high precision and the ability to withstand high temperature conditions.

BACKGROUND OF THE INVENTION

An electron beam gun, or emitter, is an electrical component used in a wide variety of vacuum devices. Low power electron beam guns, for example, are commonly used in cathode ray tube (CRT) displays. High power electron beam guns are used in microwave linear beam vacuum devices such as klystrons and gyrotrons, which have applications to particle accelerators and nuclear fusion reactors. For example, the International Thermonuclear Experimental Reactor (ITER) tokamak has an electron cyclotron heating (ECH) system that uses gyrotrons to inject over 20 MW RF power into the plasma. Unfortunately, current gyrotrons lack reproducibility of power and efficiency parameters, most likely due to material variations and variability in the mechanical alignment and precision of the assembly of its components. Velocity spread has been identified as one of the main contributors to low gyrotron efficiency. One of the main sources of velocity spread is the deviation in the geometry and position of the electrodes and cathode. Small variations in the spacing and position of the electrodes can lead to a significant increase in the velocity spread and degradation of the device efficiency.

Current electron beam gun fabrication approaches are based on conventional assembly techniques; these consist of in-process machining, pinned joints and manual alignment by the gun builder. Alignment pins are used to locate precisely positioned bores formed in mating components, along with iterative manual adjustment to align critical features. Typical electron gun assembly techniques also require clearance between parts to allow for assembly, which inherently limits the achievable precision of the fabrication process. Although these fabrication approaches have been successfully employed in the past for many types of electron guns, improved precision alignment and fabrication approaches are needed for high power and high frequency applications because the clearances and tolerances achieved by conventional assembly methods result in detrimental phenomena such as frequency deviation and velocity spread, which reduce the efficiency of a device and similarly diminish the consistency of devices which are produced to satisfy the same specifications. Alignment precision and repeatability at the micron level are needed to reduce such effects in these high power applications.

There is thus a need to develop new technologies which would improve the mechanical alignment of critical gyrotrons components, particularly high power RF electron beam guns.

Villanyi in U.S. Pat. No. 4,607,187 refines the conventional approach for the alignment of electron beam gun components. Oblong and triangular alignment features are formed within the relevant components, and specially configured precision alignment pins leverage the geometric properties of these features to provide alignment of the beam-shaping apertures of the components. While this formulation of a pinned joint technique anticipates gains in the precision associated with the alignment of an individual electron beam gun, a moderate degree of complexity is inherent to the subsequent manual alignment utilized in such an alignment operation, which will lead to variation in the fabrication and performance of identically constructed devices. Moreover, the slight deviations in form and position between the nominal design and the actual alignment features of each of the components will exacerbate the variation of alignment that is associated with this technique, and therefore the increase the discrepancy in performance between devices.

Scarpetti et al. in U.S. Pat. No. 5,416,381 discuss a scheme for aligning the components of an electron beam gun while streamlining the associated assembly process. This methodology is reliant upon the use of ceramic standoffs as alignment features, which provides desirable electrical isolation of the cathode from the anode and thereby reduces the number of necessary components. However, this technique fails to achieve sub-micron precision in the alignment of these critical device components, citing machining tolerances of ±0.0005 in. which are applied to the alignment bores. As discussed previously, this limited precision will result in inefficient operation and will incur poor repeatability and corresponding variation between identical devices.

A kinematic coupling is a device used in a variety of applications requiring the alignment of mating components to be precise and repeatable. In order to fully constrain the respective orientation of two mating components, a kinematic coupling forms deterministic contact between mating elements of each component. In a typical kinematic coupling, there are few contact locations, each constraining one degree of freedom between the mating components. The loading which can be sustained by this approach is fundamentally limited by the Hertzian contact stresses incurred at the point contact regions where the elements meet, rendering kinematic couplings generally unsuitable for use in machining operations and other processes with high loading demands.

In U.S. Pat. No. 6,193,430, Culpepper and Slocumb undertake twofold approaches to the problem of increasing the mechanical loading capacity of a kinematic coupling joint. By implementing a quasi-kinematic coupling, with spherical convex contact surfaces mating with conical concave depressions, the regions of point contact in a true kinematic coupling are replaced by line contact regions, augmenting the load-bearing capacity of the contact in the direction normal to the conical depressions. In addition, the selection of deformable materials to form the convex contact surface will allow the opposing mating surfaces to be brought into contact by the preloading fastening force, allowing the bulk material of the mating parts to bear load normal to these faces. However, the use of deformable materials reduces the precision and repeatability of the coupling while diminishing thermal stability in high temperature applications and rendering such a coupling incompatible with ultrahigh vacuum environments.

In addition, there are several other problems with the use of a kinematic coupling in an electron gun, or even generally in an electron beam device. In an electron gun there are high electric gradients with DC operating voltages of 100 kV or greater. There are also very high thermal gradients with electron beam emitter, the cathode, typically operating at a temperature of 1000 degrees C. or higher. Two additional considerations are that all materials utilized in a gyrotron gun and most other gyrotron gun should be non-magnetic, as well as that the device undergoes thermal processing "bake-out" at 500-600 degrees C. for a period of up to one week. These constraints present significant technical barriers to the use of kinematic coupling in an electron gun.

SUMMARY OF THE INVENTION

In one aspect, the present invention provides an electron beam device whose components are precisely aligned and joined using a kinematic coupling. The kinematic coupling creates a deterministic interface having six points of contact between the mating components, which fully constrains the respective orientation of the mating components. Convex coupling elements are fabricated to withstand concentrated Hertzian contact stresses in high temperature applications. The coupling elements are individually joined to the first mating component in a manner which is compatible with ultra-high vacuum environments and which enables repeatable alignment and use in machining operations through high mechanical stiffness. Machining of mating components in the final assembly position ensures precise alignment in an electron beam device.

The present invention provides an electron beam device having at least one kinematic coupling with very high precision and repeatability. The kinematic coupling deterministically locates and aligns one electron beam device component with respect to a mating component. It retains functionality in high temperature conditions and has compatibility with ultrahigh vacuum environments.

Preferably, the kinematic coupling uses a novel integrated structure. Usually the high voltage insulator (ceramic assembly) of an electron gun is a separate assembly, used only to provide electrical insulation (100 kV or higher) and provide a vacuum envelope. In embodiments of the present invention, the high voltage ceramic becomes a structural component of the electron gun and forms the base of the kinematic coupling in addition to the high voltage insulator. This integrated function is a unique physical attribute of embodiments of the invention, and it provides for a more compact design and reduced high voltage region, decreasing the potential of electric break down which is one of the significant issues with electron guns and devices.

The kinematic coupling elements are fixed to the electron beam gun components using a unique direct metal to ceramic bonding process using brazing. This process involves using a high temperature active metal brazing alloy (at over 1000 degrees C.) to bond ceramic coupling elements to non-ductile rigid base metals. The ceramic elements are on the order of ½ inch diameter. The use of high strength ceramics, e.g., silicon nitride, provides another key feature. Most conventional ceramic brazing is performed using aluminum oxide ceramics. Direct bonding conventionally uses a lower melting braze material at under 800 degrees C., containing silver which is not desirable and also use thermal expansion matched metals, e.g., kovar (a nickel-cobalt ferrous alloy). However, kovar is magnetic, making it not suitable for use in electron guns. Also, these thermally expansion matched metals only work to a braze temperature of about 800 degrees, above that the thermal expansion between ceramics and the base metal starts to diverge and the stresses tend to become too high.

Embodiments of the present invention overcome these problems through the use of high strength ceramics in an electron gun and direct metal to ceramic bonding process using a brazing process with a high temperature active metal brazing alloy. In addition, a unique braze joint geometry limits the braze stresses in the ceramic. The geometry is a counterbored shape with a groove along the outer diameter of the counterbore.

The techniques of the present invention allow the fabrication of very high precision vacuum device components for applications such as gyrotron, with the potential to dramatically improve performance. A very high precision electron gun will produce a higher quality electron beam, by reducing velocity spread and enabling additional gun design optimization. Furthermore, by utilizing very high precision electron guns in gyrotrons the reproducibility between devices would be significantly improved.

Using the techniques of the present invention, electron gun components such as cathode and electrodes may simply be stacked using precision kinematic coupling interfaces. No additional alignment or adjustment procedures are required, resulting in the realization of significant labor time and cost savings. Thus this technology can significantly improve the electron gun performance while at the same time reducing assembly costs and time.

The present technology has the potential to be broadly adopted across the vacuum electronics industry. The benefits of the technology, reduced cost and improved precision, would drive interest to expand to additional applications in klystrons, accelerators and THz devices.

In one aspect, the invention provides an electron beam gun that includes a first component, which is a non-ductile rigid metal, joined to a second component by a fixed kinematic coupling. The fixed kinematic coupling includes convex ceramic elements composed of silicon nitride or silicon carbide directly bonded to the first component using a high temperature active metal brazing alloy having a melting temperature higher than 970 degrees C., and concave grooves in the second component arranged to mate with the convex ceramic elements. Preferably, the second component is a ceramic. The first non-ductile rigid metal component may be, for example, a beam shaping focus electrode or cathode assembly, and the second component may be a gun stem.

In one aspect, the invention provides an electron beam gun for a high power RF vacuum device. The device includes a cathode stem and an anode assembly, both joined to a base. The anode assembly includes an anode, and the cathode stem includes a gun stem, a fixed kinematic coupling, a cathode assembly, and a beam shaping focus electrode (having inner and outer electrodes). The cathode assembly has a cathode housing (support sleeve) made of a first non-ductile rigid metal material. The cathode assembly may also have a tungsten emitter, tungsten heater, heat shields, and ceramic heater potting. The beam shaping focus electrode is similarly composed of a second non-ductile rigid metal material. The non-ductile rigid metal materials are preferably materials that retain an elastic modulus above 100 GPa at a temperature of 1000 degrees C., for example, stainless steel or molybdenum.

The cathode assembly and beam shaping focus electrode are joined to the gun stem using a fixed kinematic coupling. The kinematic coupling includes high strength ceramic elements directly bonded to the beam shaping focus electrode and to the cathode housing using a high temperature active metal brazing alloy. The kinematic coupling also includes V-grooves in the gun stem arranged to mate with the three high strength ceramic elements.

In a preferred embodiment, the kinematic coupling has three high strength ceramic elements directly bonded to the cathode housing and three high strength ceramic elements directly bonded to the focus electrode. Both the focus electrode and cathode assembly thus sit in a common kinematic coupling base (i.e. their ceramic elements all mate with the same V-grooves in the gun stem, which is preferably also a high strength ceramic). The high temperature active metal brazing alloy is preferably an active metal brazing alloy that has a melting temperature higher than 970 degrees C. The high temperature active metal brazing alloy preferably does not contain silver or nickel-cobalt ferrous alloy. The high temperature active metal brazing alloy may be, for example, an alloy of Ti, Cu—Ti, Au—Ti, Zr or Hf.

The beam shaping focus electrode may include an inner beam shaping electrode and an outer beam shaping electrode. The anode assembly may be joined to the base using a fixed kinematic coupling or other precision joint. Alternatively, the anode may be joined to a cylindrical ceramic housing of the anode assembly using a fixed kinematic coupling.

The kinematic coupling preferably has three V-grooves in the gun stem positioned to mate with the high strength ceramic elements that are bonded to the cathode assembly and focusing electrode. The high strength ceramic elements preferably have flexural strength above 500 MPa. The high strength ceramic elements, for example, may be composed of silicon nitride or silicon carbide. The kinematic coupling preferably provides electrical insulation of more than 100 kV between the anode assembly and the cathode assembly, while also providing more than 100 kV between the anode assembly and the beam shaping focus electrode. The kinematic coupling preferably also provides electrical insulation of more than 1 kV between the cathode assembly and the beam shaping focus electrode.

The electron beam gun may be part of a high power RF vacuum device such as, for example, a gyrotron, klystron, or magnetron.

BRIEF DESCRIPTION OF THE DRAWINGS

FIGS. 1A-C are cut-away perspective views of an electron beam gun for a high power RF vacuum device, according to an embodiment of the invention, where FIGS. 1B and 1C are detail views of coupling components and cathode assembly components, respectively, of FIG. 1A.

FIG. 3B is a detail view of cathode assembly components in FIG. 3A.

FIG. 4B is a cut-away exploded view.

DETAILED DESCRIPTION

Figure 2A:
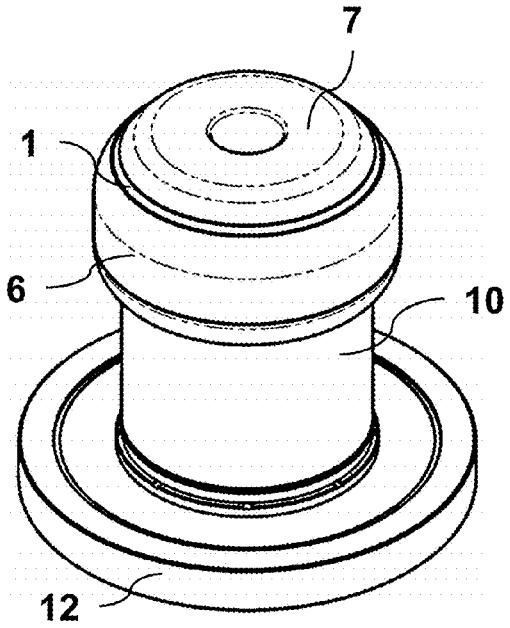
FIGS. 2A-B are two perspective views of a cathode stem, according to an embodiment of the invention.

Electron beam devices according to embodiments of the present invention feature kinematic couplings, e.g., with a ball-in-groove joint where three balls on one component mate with three grooves on the second component with small area contacts. The kinematic couplings are deterministic: They only make contact at a number of points equal to the number of degrees of freedom that are to be restrained. Being deterministic makes performance predictable and also helps to reduce design and manufacturing costs. Kinematic couplings have traditionally been used in instrument design where the loads typically are relatively light and static. Through the use of well-engineered contact areas and/or advanced ceramic materials they are can be made quite robust and suitable for demanding applications requiring high stiffness and load capacity.

FIGS. 1A-C are cut-away perspective views of an electron beam gun for a high power RF vacuum device according to an embodiment of the invention. As shown in FIG. 1A, it includes a cathode stem comprising a base 12, gun stem 10 joined to the base 12, and beam shaping focus electrodes (outer focus electrode 6 and inner focus electrode 7). It also includes a cathode assembly, labeled A and B, which are detailed in FIGS. 1B-C, respectively. The cathode assembly has a tungsten cathode/emitter 1, tungsten heater 2, ceramic heater potting 3, heat shields 4, and a cathode housing (support sleeve) 5. The cathode housing 5 is made of a non-ductile rigid metal material. The beam shaping focus electrode 6 and 7 is similarly composed of a second non-ductile rigid metal material. The cathode assembly is joined to the gun stem 10 using a fixed kinematic coupling element 8*a* which mates with V-groove 9. The beam shaping focus electrode (which includes outer electrode 6 and inner electrode 7) is joined to gun stem 10 using fixed kinematic coupling element 8*b* which also mates with V-groove 9. The kinematic coupling preferably has three high strength ceramic elements directly bonded to the beam shaping focus electrode 6 using a high temperature active metal brazing alloy. The kinematic coupling preferably also has three high strength ceramic elements directly bonded to the cathode assembly (e.g., to the cathode housing 5) using a high temperature active metal brazing alloy. The kinematic coupling has three V-grooves 9 in the gun stem positioned to mate with the three high strength ceramic elements. In a preferred implementation, the gun stem is ceramic and acts as a high voltage ceramic assembly. The electron beam gun may also include an anode assembly that includes a cylindrical housing 13 joined to the base 12, and an anode 11 joined to the cylindrical housing 13. The cylindrical housing may be metal. In an alternate embodiment, the cylindrical housing 13 may be ceramic, in which case it is a high voltage ceramic assembly, and the gun stem 10 may be a metal.

Figure 3B:
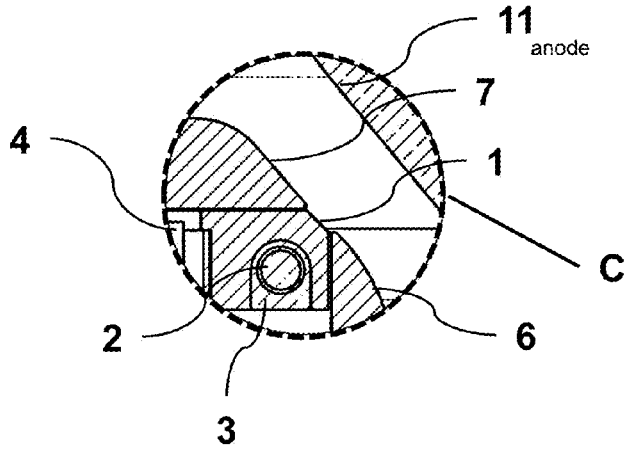
FIGS. 3A-B are cross-sectional views of an electron beam gun, according to an embodiment of the invention, where
Figure 3A:
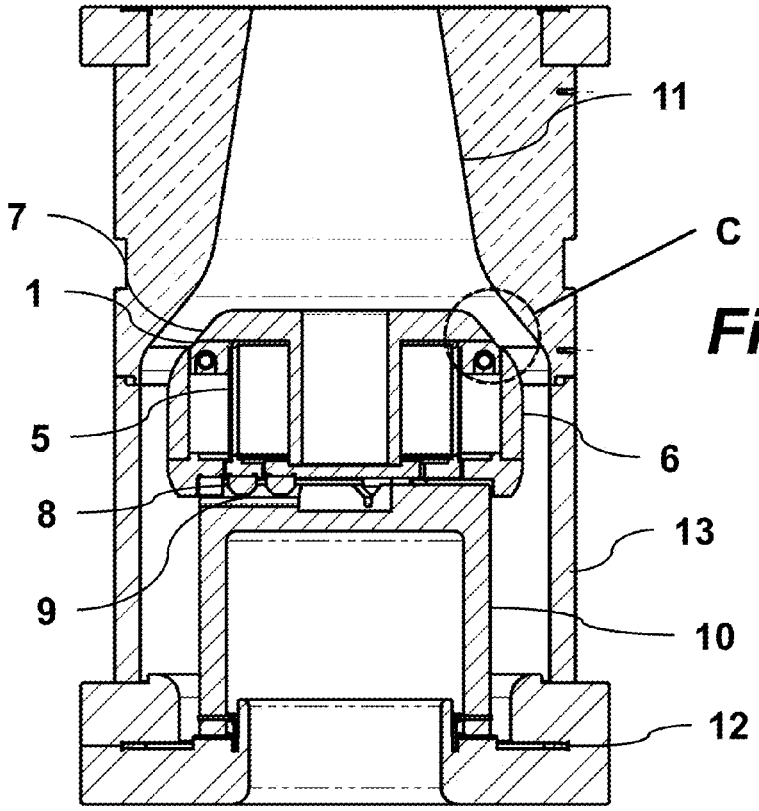

FIG. 3A is a cross-sectional view of the same device as shown in FIG. 1A, and FIG. 3B is a detail view of cathode assembly components, labeled C in FIG. 3A.

Figure 2B:
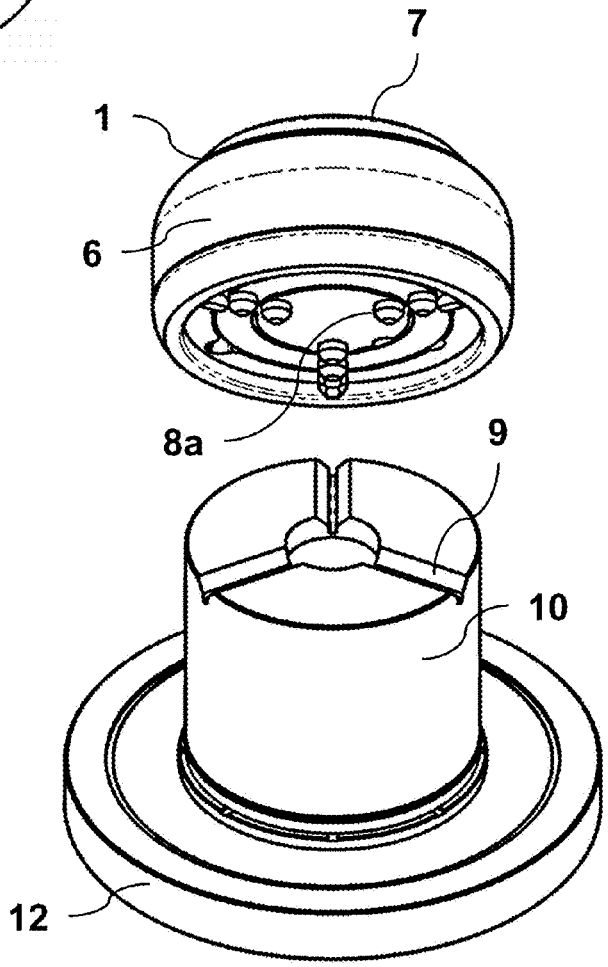

FIGS. 2A-B are two views of the cathode stem. As shown in FIG. 2A, the cathode stem has a base 12, gun stem 10 joined to the base 12, beam shaping focus electrode (including outer focus electrode 6 and inner focus electrode 7), and a cathode/emitter 1 between the two electrodes 6 and 7. As shown in the exposed view of FIG. 2B, the gun stem has at its top three coupling V-grooves 9, each with its axis oriented radially. Matching coupling elements 8, each preferably with a hemispherical shape, are attached to cathode assembly and focus electrode and are positioned to align with the V-grooves 9 to form a kinematic coupling.

A key feature of the electron beam gun is the kinematic coupling joint, which includes grooves and matching coupling elements. Through the use of silicon nitride or other high strength ceramics, the coupling elements thereby are suitable for use as voltage offset elements and are mechanically capable of withstanding concentrated Hertzian contact stresses in high-temperature applications. A direct metal-to-ceramic braze is a permanent and rigid joint which is compatible with UHV environments and which enables repeatable alignment and in-process machining use through high mechanical stiffness.

Figure 4A:
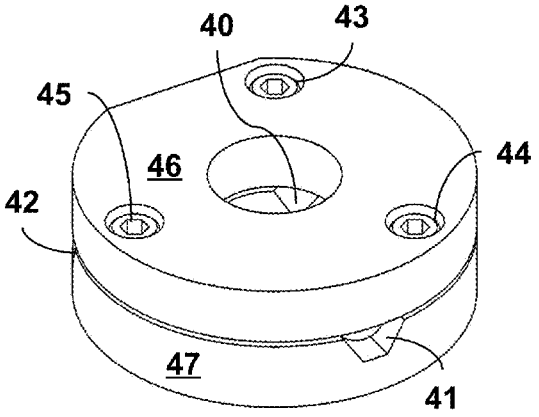
FIGS. 4A-B are two perspective views of a kinematic coupling, according to an embodiment of the invention, where
Figure 4B:
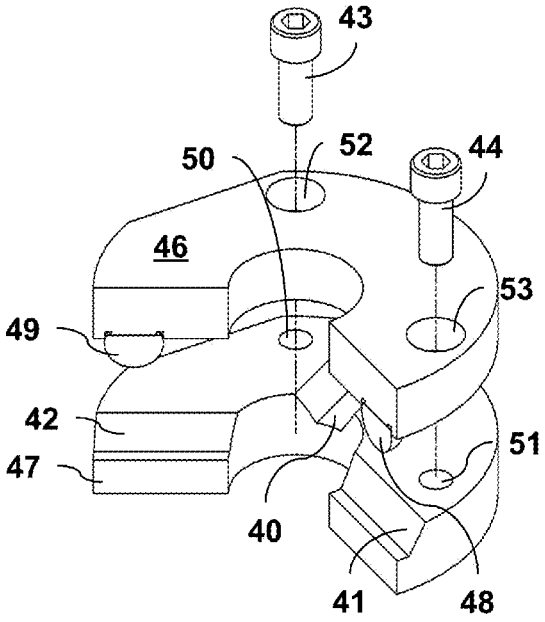

An illustration of a kinematic coupling in two configurations according to an embodiment of the invention is shown in FIGS. 4A-B. The coupling has top component 46 aligned coaxially with a base component 47, each having the shape of an annulus. Three coupling bolts 43, 44, 45, oriented parallel to the axis of the top and base components, hold the two components together. Top component 46 has counterbore holes (e.g., hole 52 for bolt 43 and hole 53 for bolt 44) and base component 47 has holes aligned with them (e.g., hole 50 for bolt 43 and hole 51 for bolt 44). The base component 47 has three V-grooves 40, 41, 42 designed to mate with corresponding hemispherical coupling elements brazed to the top component 46 (e.g., hemispherical coupling element 48 mates with V-groove 41 and hemispherical coupling element 49 mates with V-groove 42). The three V-grooves are preferably oriented radially 120 degrees apart from each other.

Figure 5:
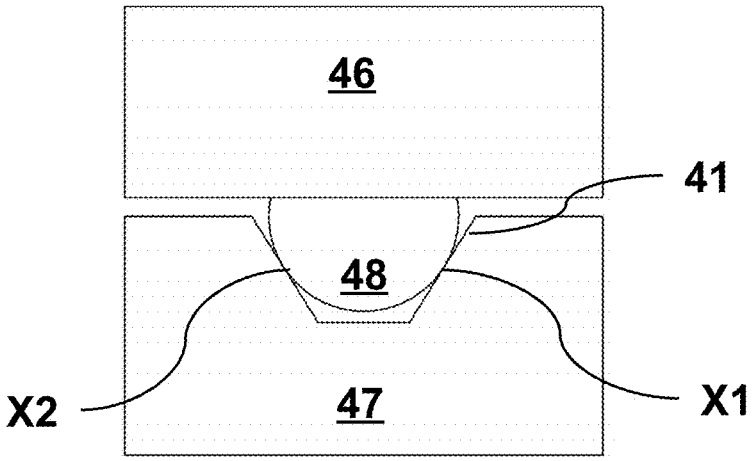
FIG. 5 is a cross-sectional detail view of a portion of a kinematic coupling showing convex coupling element mated with concave groove feature with two points of contact, according to an embodiment of the invention.

More generally, the kinematic coupling has top and base electron beam device components 46, 47 to be mated, as shown in FIG. 5. A top component 46 has a plurality of convex coupling features (e.g., hemispherical coupling elements 48) and a base component 47 has a plurality of concave coupling elements (e.g., grooves 41) that are formed in or joined to the base mating component 47 and are designed to receive and deterministically align the top mating component with respect to the base mating component when in contact with the plurality of convex coupling elements 48. A plurality of fastening elements (e.g., coupling bolts, see FIG. 4B) hold the two components in static contact at deterministic points X1, X2. The plurality of concave coupling features 41 is preferably formed within or joined to the base coupling component 47 with planar contact surfaces to form an arrayed V-groove configuration.

The plurality of convex coupling elements 48 preferably provide electrical insulation between the coupling features. For example, they are preferably fabricated from a ceramic such as silicon nitride. The plurality of convex coupling elements 48 are individually joined to the top component 46 using a direct metal-to-ceramic bond.

Figures 6A, 6B, 6C, 6D, 6E, 6F:
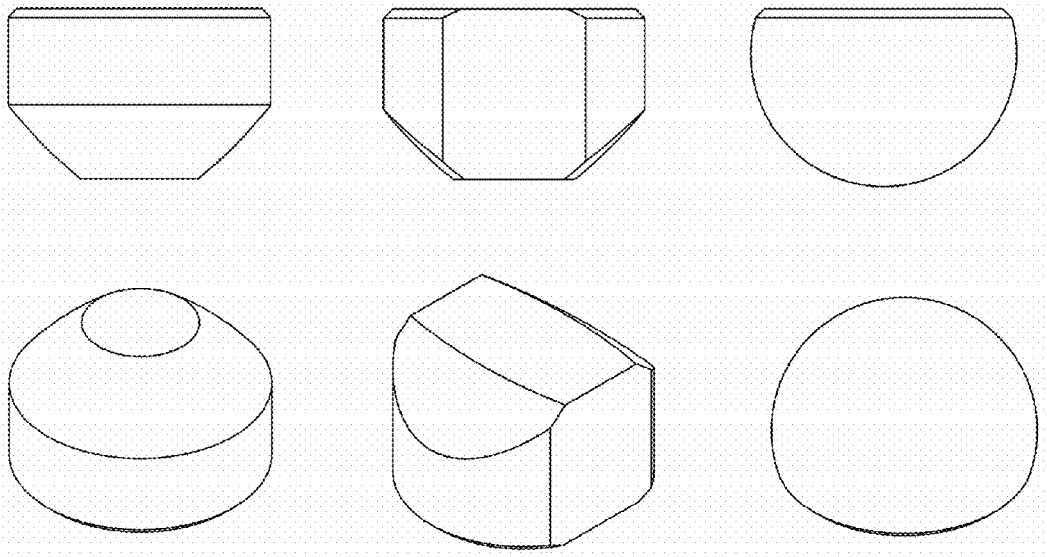
FIGS. 6A-F show side and perspective views of differently shaped contact surfaces of convex coupling elements, according to three embodiments of the invention.

The plurality of convex coupling elements 48 generally may a convex shape as a contact surface. For example, FIGS. 6A-B show side and perspective views, respectively, of a truncated cone shaped contact surface. FIGS. 6C-D show side and perspective views, respectively, of a truncated triangular prism shaped contact surface. FIGS. 6E-F show side and perspective views, respectively, of a hemispherical shaped contact surface. It will be evident that these examples are not limiting, and that many other convex shapes may be used for the contact surface.

In the gun region there are high electric and thermal gradients, and the coupling also must meet the general ultra-high vacuum requirements for good electron beam emission and transmission.

Ceramic coupling elements are preferably used on the ball side of the kinematic coupling in order to accommodate Hertzian contact stresses. The ceramic coupling elements are preferably made of a ceramic material with high strength, fracture toughness, and strength at elevated temperatures. Specifically, the high strength ceramic elements preferably have flexural strength above 500 MPa. The high strength ceramic elements, for example, may be composed of silicon nitride or silicon carbide.

The ceramic coupling elements are permanently and rigidly attached to the base metal to allow for precision alignment. For this purpose, a braze joint design was developed, which allowed the direct bonding of silicon nitride ceramic elements to various metals. Brazing silicon nitride (with its low coefficient of thermal expansion) to metals such as stainless steel (with much higher rates of thermal expansion) presents a challenge due to stresses which result from the thermal expansion differential. The inventor has discovered that with the high strength silicon nitride ceramics it is possible to achieve a direct bond without the need for an intermediate ductile metal layer, as frequently utilized in ceramic assemblies. A finite element simulation shows the resultant principal stresses in a silicon nitride coupling element when brazed to a stainless steel base has a peak tensile stress of 680 MPa, which is approximately 20% below the 800 MPa tensile strength of the silicon nitride ceramic. For the braze process a high temperature melting active metal braze alloy is utilized. The result is a high stiffness mechanical joint between the ceramic and the base metal. The high temperature active metal brazing alloy is preferably an active metal brazing alloy that has a melting temperature higher than 970 degrees C. It preferably does not contain silver or nickel-cobalt ferrous alloy. The high temperature active metal brazing alloy may be, for example, an alloy of Ti, Cu—Ti, Au—Ti, Zr or Hf.

The cathode housing (support sleeve) is made of a non-ductile rigid metal material. The beam shaping focus electrode is similarly composed of a non-ductile rigid metal material. Such a non-ductile rigid metal material may be defined for the purposes of the present description has a material that retains an elastic modulus above 100 GPa at a temperature of 1000 degrees C. For example, the non-ductile rigid metal material may be molybdenum or stainless steel. In a preferred embodiment, the gun stem is made of a stainless steel and the focus electrode is made of molybdenum.

The use of precision couplings between individual components of the gun provides new opportunities for simplifying and improving the design of electron guns. The kinematic coupling allows the use of dissimilar materials across mechanical interfaces, whereas in a traditional type of electron gun these key joint are welded and the joint materials must be similar or weld compatible. The kinematic coupling allows for the key individual components such as the focus electrode to be entirely fabricated from the most suitable material for electron beam shaping; interface and mounting are handled by the kinematic coupling and are no longer a limiting factor in the overall gun design.

The inner and outer focus electrodes are near-net-shape molybdenum pieces with sufficient extra material on the exterior surface to allow for high precision final machining. After the successful braze of the focus electrodes, the focus electrodes are mounted onto the cathode stem and final machined. The ease and precision of assembly enabled by the kinematic coupling allows the focus electrodes to be machined directly on the cathode stem, preserving the mounting configuration used in a gyrotron device.

For the cathode, a custom cathode base may be fabricated, which together with associated tooling specifically engineered for this application allows cathode vendors to furnish a complete cathode assembly for the gun. The cathode assembly mates to the electron gun stem with its own coupling.

It will be evident from those skilled in the art that the teachings and principles of the present invention do not limit an electron gun design to the particular design shown in the embodiments for purposes of illustration. Different mechanical gun designs are possible for different specific purposes and applications. The designs may differ, for example, in the location of the kinematic coupling. Embodiments may also include additional kinematic couplings, e.g., between the inner focus electrode and the cathode assembly, and/or between the anode assembly and the base. Different designs may be thermally analyzed using finite element analysis software. Based on manufacturing considerations and thermal performance, appropriate specific designs may be selected.

The invention claimed is:

1. An electron beam gun for a high power RF vacuum device comprising:

a base, a cathode stem, and an anode assembly; wherein the cathode stem and anode assembly are joined to the base;

wherein the anode assembly comprises an anode;

wherein the cathode stem comprises a gun stem, a fixed kinematic coupling, a cathode assembly, and a beam shaping focus electrode, wherein the cathode assembly comprises a cathode housing made of a first non-ductile rigid metal material;

wherein the beam shaping focus electrode is composed of a second non-ductile rigid metal material, wherein the cathode assembly and beam shaping focus electrode are joined to the gun stem using the fixed kinematic coupling, wherein the fixed kinematic coupling comprises high strength ceramic elements directly bonded to the beam shaping focus electrode and cathode housing using a high temperature active metal brazing alloy, wherein the kinematic coupling comprises V-grooves in the gun stem to mate with the three high strength ceramic elements.

2. The electron beam gun of claim 1 wherein the beam shaping focus electrode comprises an inner beam shaping focus electrode and an outer beam shaping focus electrode, wherein the outer beam shaping focus electrode is joined to the gun stem using the fixed kinematic coupling.

3. The electron beam gun of claim 1 wherein the anode assembly is joined to the base using a fixed kinematic coupling.

4. The electron beam gun of claim 1 wherein the first non-ductile rigid metal material is a first material that retains an elastic modulus above 100 GPa at a temperature of 1000 degrees C., and wherein the second non-ductile rigid metal material is a second material that retains an elastic modulus above 100 GPa at a temperature of 1000 degrees C.

5. The electron beam gun of claim 1 wherein the gun stem is composed of a high strength ceramic.

6. The electron beam gun of claim 1 wherein the first non-ductile rigid metal material is stainless steel or molybdenum, and wherein the second non-ductile rigid metal material is stainless steel or molybdenum.

7. The electron beam gun of claim 1 wherein the high temperature active metal brazing alloy is an active metal brazing alloy that has a melting temperature higher than 970 degrees C.

8. The electron beam gun of claim 1 wherein the high temperature active metal brazing alloy does not contain silver or nickel-cobalt ferrous alloy.

9. The electron beam gun of claim 1 wherein the high temperature active metal brazing alloy is an alloy of Ti, Cu—Ti, Au—Ti, Zr or Hf.

10. The electron beam gun of claim 1 wherein the high strength ceramic elements have flexural strength above 500 MPa.

11. The electron beam gun of claim 1 wherein the high strength ceramic elements are composed of silicon nitride or silicon carbide.

12. The electron beam gun of claim 1 wherein the kinematic coupling provides electrical insulation of more than 100 kV between the cathode assembly and the anode assembly.

13. The electron beam gun of claim 1 wherein the kinematic coupling provides electrical insulation of more than 100 kV between the beam shaping focusing electrode and the anode assembly.

14. The electron beam gun of claim 1 wherein the kinematic coupling provides electrical insulation of more than 1 kV between the beam shaping focusing electrode and the cathode assembly.

15. The electron beam gun of claim 1 wherein the cathode assembly further comprises a tungsten emitter, tungsten heater, heat shields, and ceramic heater potting.

16. The electron beam gun of claim 1 wherein the high power RF vacuum device is a gyrotron, klystron, or magnetron.

17. An electron beam gun comprising a first component joined to a second component by a fixed kinematic coupling, wherein the first component is a non-ductile rigid metal, and wherein the fixed kinematic coupling comprises:

convex ceramic elements composed of silicon nitride or silicon carbide directly bonded to the first component using a high temperature active metal brazing alloy having a melting temperature higher than 970 degrees C., and concave grooves in the second component arranged to mate with the convex ceramic elements.

18. The electron beam gun of claim 17 wherein the first component is a beam shaping focus electrode.

19. The electron beam gun of claim 17 wherein the first component is a cathode housing.

20. The electron beam gun of claim 17 wherein the second component is a ceramic gun stem.

* * * * *